United States Patent [19]

Gregory et al.

[11] 4,237,934

[45] Dec. 9, 1980

[54] VACUUM FLUSH WATER CLOSET

[75] Inventors: Charles E. Gregory, Anchorville; Michael Brian, Orchard Lake; Jerald F. Thomas, Utica; James F. Cameron, Milford, all of Mich.

[73] Assignee: Jered Brown Brothers, Inc., Troy, Mich.

[21] Appl. No.: 928,879

[22] Filed: Jul. 28, 1978

Related U.S. Application Data

[62] Division of Ser. No. 804,234, Jun. 6, 1977, Pat. No. 4,144,903, which is a division of Ser. No. 435,511, Jan. 22, 1974, Pat. No. 4,041,554.

[51] Int. Cl.[3] ..... F16K 11/00

[52] U.S. Cl. ..... 137/637; 137/595; 137/596; 251/289; 251/14

[58] Field of Search ..... 137/595, 596, 637; 251/80, 14, 289

[56] References Cited

U.S. PATENT DOCUMENTS

| | | | |
|---|---|---|---|
| 2,459,883 | 1/1949 | Kelley | 137/595 |
| 3,229,721 | 1/1966 | Bingel | 251/80 X |
| 3,463,557 | 8/1969 | Alfieri | 137/595 X |
| 3,871,537 | 3/1975 | Bernhoft | 251/50 X |

FOREIGN PATENT DOCUMENTS

| | | | |
|---|---|---|---|
| 770835 | 3/1957 | United Kingdom | 137/595 |
| 930442 | 7/1963 | United Kingdom | 137/595 |

*Primary Examiner*—Alan Cohan
*Attorney, Agent, or Firm*—Robert G. Mentag

[57] ABSTRACT

A vacuum flush water closet having a bowl and rim which are made from steel stampings covered with chemical resistant porcelain. The water closet has a self-contained flushing water and sewage valve discharge control system which is operatively mounted around the bowl and enclosed by an outer shroud made of a molded high impact plastic material. The water closet is shock proof and is mounted on a base plate that may be fixedly secured to a mounting surface, such as a floor or ship's deck. The bowl is mounted on a sewage discharge valve which is spring closed and vacuum opened. Flushing water is supplied through a spray ring mounted around the upper end of the bowl. The flushing water is controlled by a vacuum operated valve. The operation of the flushing water valve and the sewage discharge valve is controlled by a vacuum-gravity timer which is activated by a push button switch mounted at the rear of the bowl rim. The length of the flushing cycle and the sewage discharge cycle is controlled by the vacuum-gravity timer. The flushing cycle takes place in a short time interval and a minimum amount of water is employed for flushing purposes.

1 Claim, 17 Drawing Figures

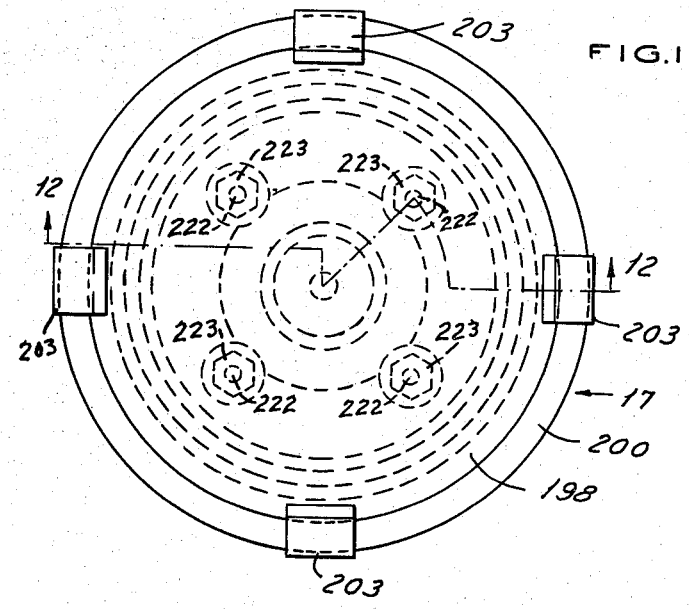
FIG.11
FIG.12
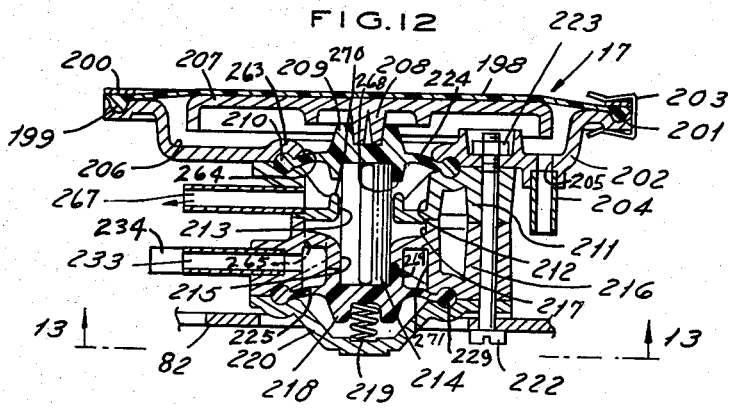
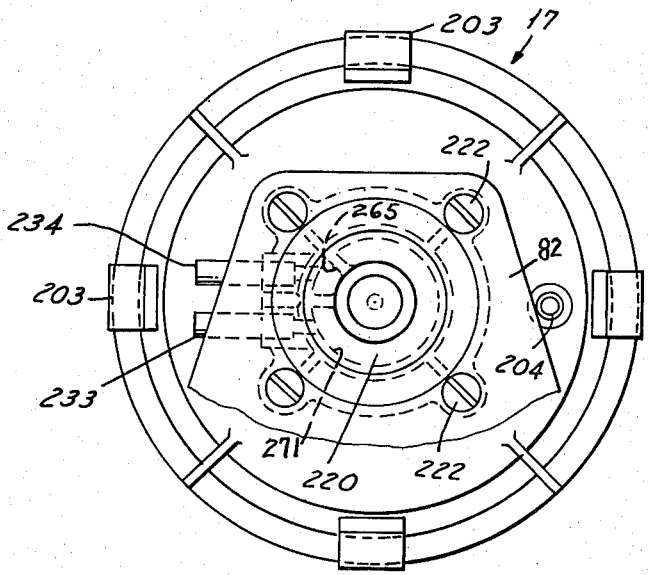
FIG.13

VACUUM FLUSH WATER CLOSET

This is a division of application Ser. No. 804,234 filed on June 6, 1977, and new U.S. Pat. No. 4,144,903, which application was a division of application Ser. No. 435,511 filed on Jan. 22, 1974, and now U.S. Pat. No. 4,041,554.

SUMMARY OF THE INVENTION

This invention relates to the art of sanitary plumbing systems, and more particularly, to a novel and improved vacuum flush water closet.

Vacuum sewage systems have been provided heretofore, but they have had inherent disadvantages. A disadvantage of the prior art vacuum flush water closets is that they are expensive, bulky, and subject to breakage. Another disadvantage of the prior art vacuum flush water closets is that they include control systems which are slow and inefficient in operation. A further disadvantage of the prior art vacuum flush water closets is that they are not shock-proof and cannot be used for systems for naval ships. In view of the foregoing, it is an important object of the present invention to provide a novel and improved vacuum flush water closet which overcomes the aforementioned disadvantages of the prior art vacuum flush water closets.

It is another object of the present invention to provide a novel and improved vacuum flush water closet which is simple and compact in construction, light in weight, economical to manufacture, and efficient in operation.

It is a further object of the present invention to provide a vacuum flush water closet which is shock-proof and may be used in naval ships and under conditions where the water closet will be subjected to shocks and excessive vibrations.

It is still another object of the present invention to provide a novel and improved vacuum flush water closet which is provided with a bowl and rim made from metal stampings that are covered with a chemical resistant porcelain and which has a self-contained flushing water and sewage valve discharge control system operatively mounted around the bowl and enclosed by a shroud made of a molded high impact plastic material.

It is still another object of the present invention to provide a novel and improved vacuum flush water closet having a vacuum operated sewage discharge valve on which is operatively mounted a bowl having a rim and on which is mounted a seat. The sewage discharge valve is operatively mounted on a base plate. A flushing water vacuum control valve is operatively mounted on the bowl. A vacuum operated control means is operatively mounted on the bowl for controlling the flushing water flow control valve and the sewage discharge valve. A shroud is operatively mounted around the bowl to enclose the flushing water flow control valve, the sewage discharge valve, the bowl and the control apparatus.

It is still another object of the present invention to provide a novel and improved vacuum flush water closet having a vacuum operated sewage discharge valve which is controlled by a vacuum control system that includes a vacuum and gravity operated timer means.

It is still another object of the present invention to provide a novel and improved vacuum flush water closet which is adjustable for regulating the water flushing portion of the overall flushing cycle, and the sewage discharge portion of the overall flushing cycle, so as to provide an overall flushing cycle which uses a minimum amount of flushing water and is carried out over a minimum time period to maintain the volume of air to a minimum that is being drawn into the vacuum line connected to the water closet.

It is still another object of the present invention to provide a vacuum flush water closet having a bowl and a detachably mounted flushing water spray ring operatively mounted therein, and wherein said spray ring comprises a tubular ring having a plurality of downwardly extended discharge holes that are formed at an acute angle relative to the vertical axis of the bowl.

It is still another object of the present invention to provide a vacuum flush water closet which includes a vacuum operated sewage discharge valve, a bowl having an outlet neck at the lower end thereof which is operatively connected to said sewage discharge valve, said bowl having an open upper end with the rim therearound, a seat operatively mounted on said rim, a flushing water supply means operatively mounted on said bowl for supplying a predetermined amount of flushing water into said bowl, and a control system for selectively activating said sewage discharge valve and said flushing water supply means for a predetermined flushing cycle.

Other features and advantages of this invention will be apparent from the following detailed description, appended claims, and the accompanying drawings.

BRIEF DESCRIPTION OF THE DRAWINGS

FIG. 11 is a plan view of a vacuum dispensing valve illustrated in FIG. 3, taken along the line 11—11 thereof, and looking in the direction of the arrows.

FIG. 12 is a fragmentary, elevational, section view of the structure illustrated in FIG. 11, taken along the line 12—12 thereof, and looking in the direction of the arrows.

FIG. 13 is a bottom plan view of the structure sectionally illustrated in FIG. 12, taken along the line 13—13 thereof, showing the entire structure and looking in the direction of the arrows.

DESCRIPTION OF THE PREFERRED EMBODIMENT

Figure 1:
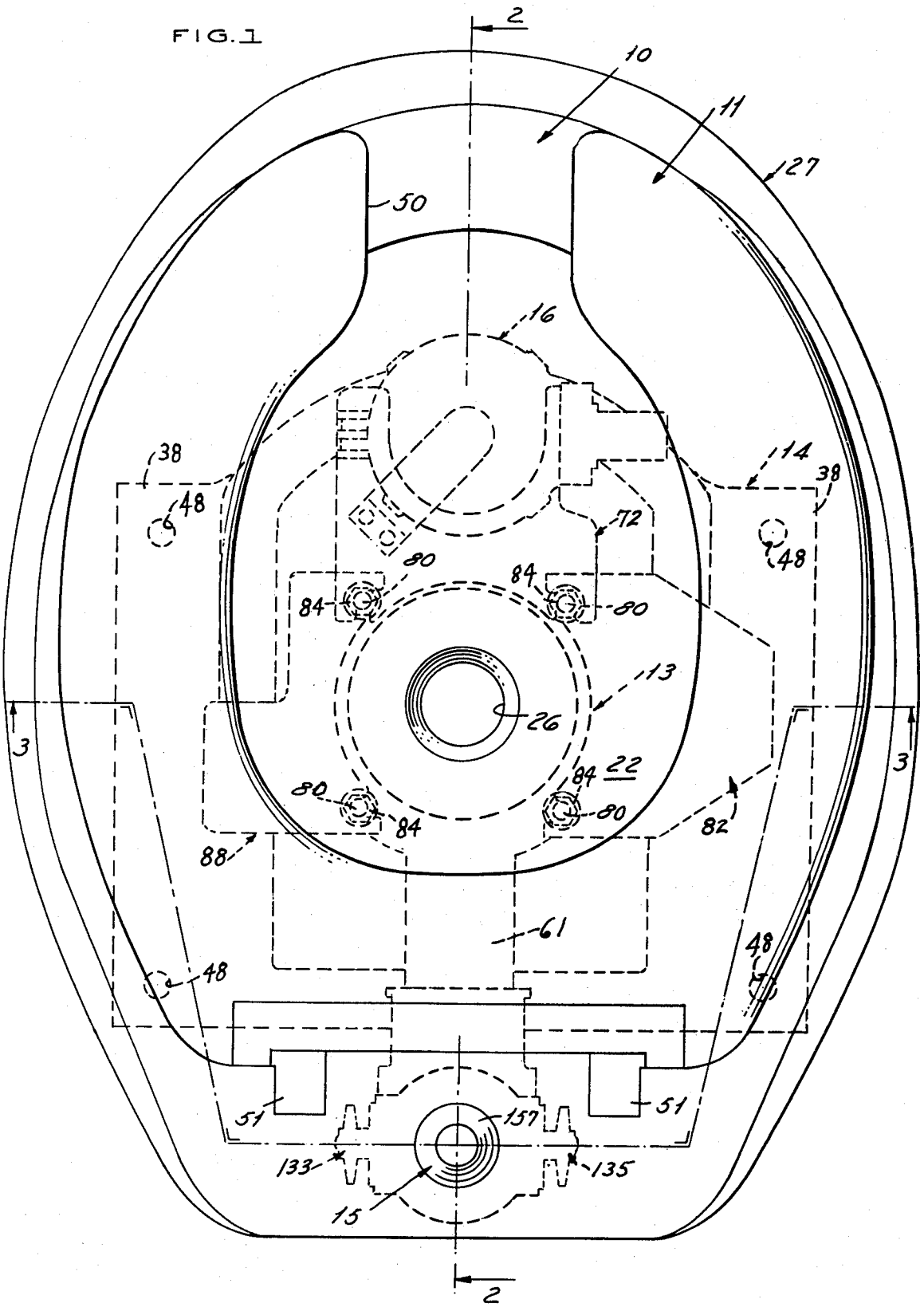
FIG. 1 is a top plan view of a vacuum flush water closet made in accordance with the principles of the present invention.
Figure 2:
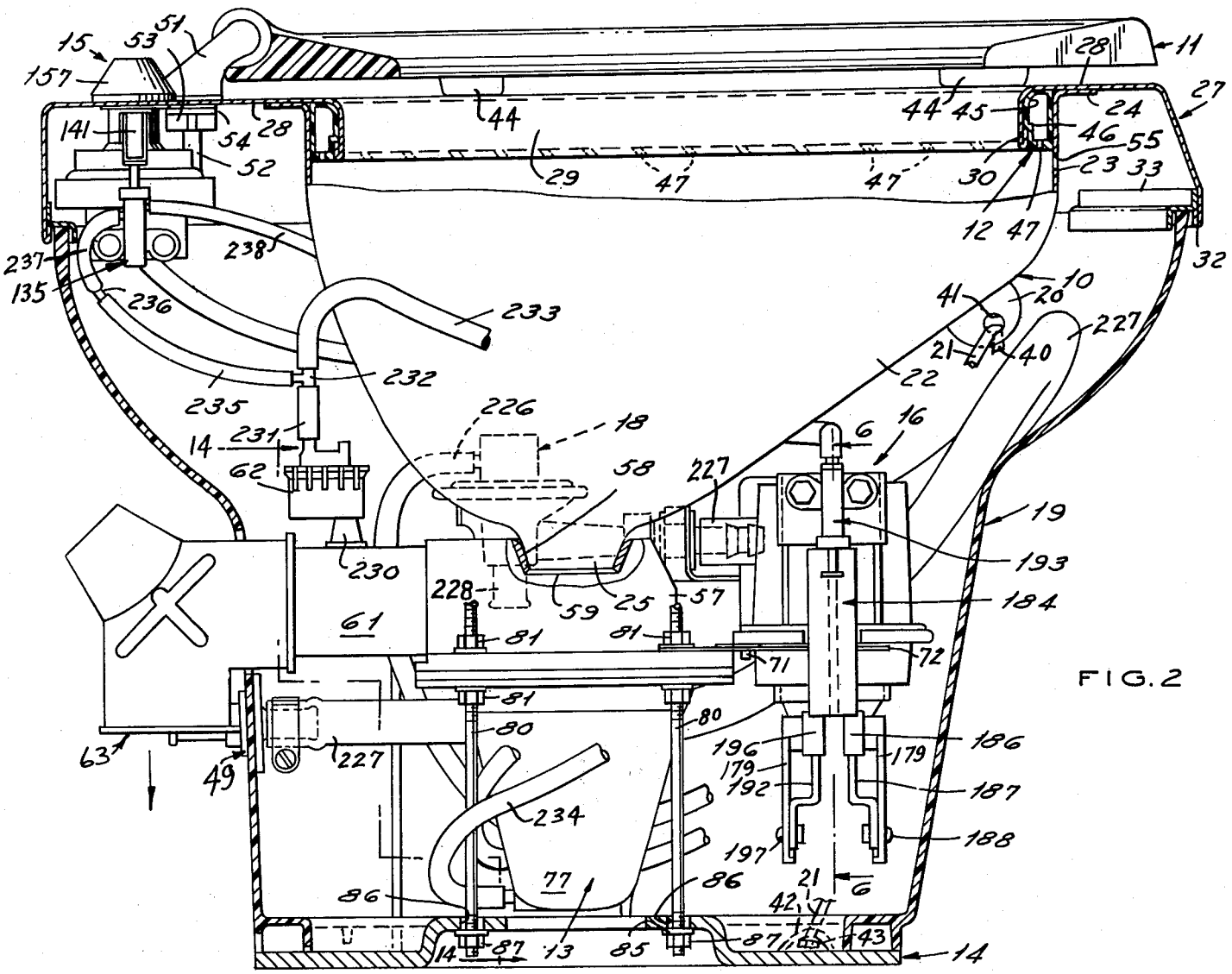
FIG. 2 is an elevational section view of the water closet struct illustrated in FIG. 1, taken along the line 2—2 thereof, and looking in the direction of the arrows.
Figure 3:
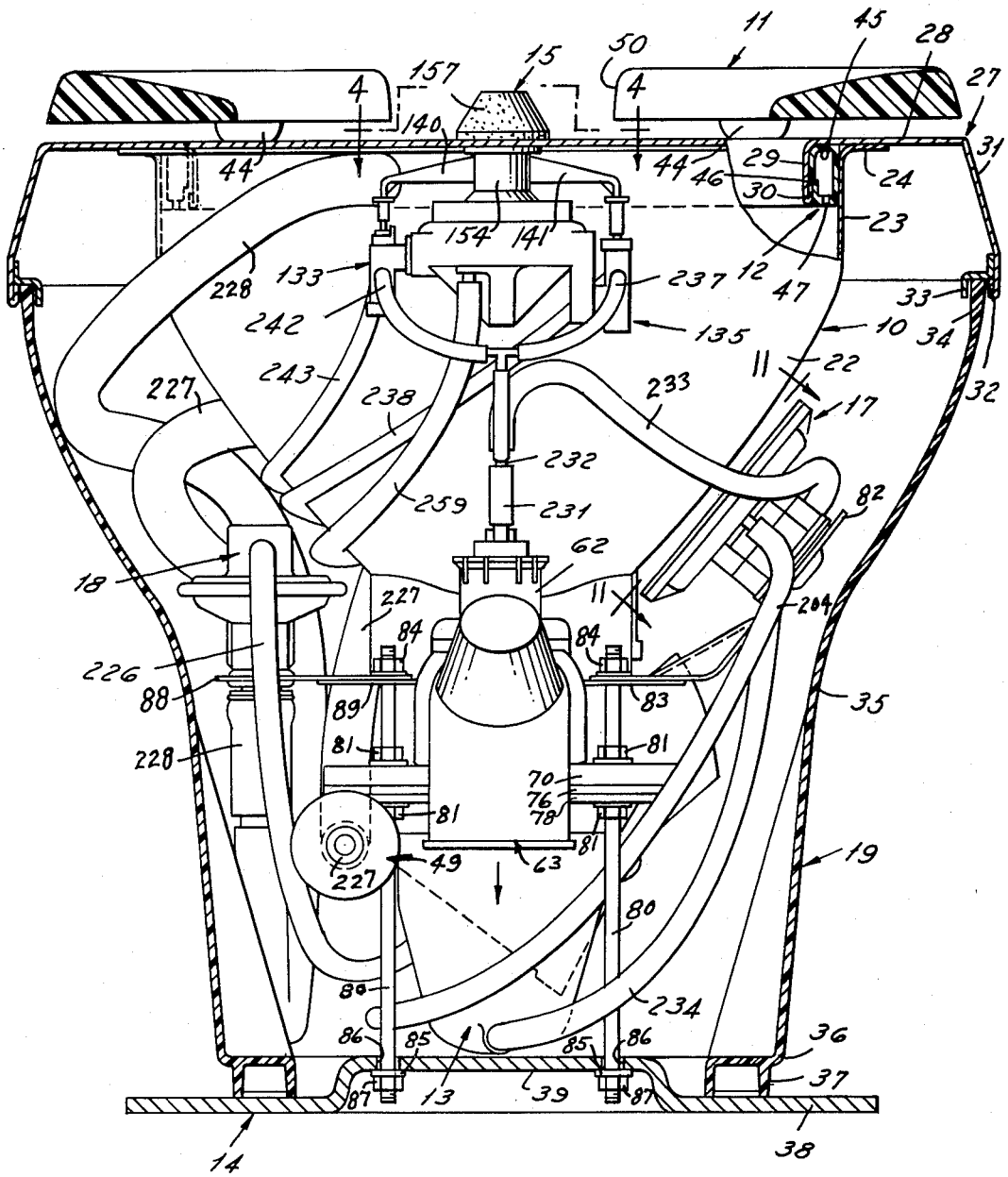
FIG. 3 is an elevational section view of the water closet structure illustrated in FIG. 1, taken along the line 3—3 thereof, and looking in the direction of the arrows.
Figure 4:
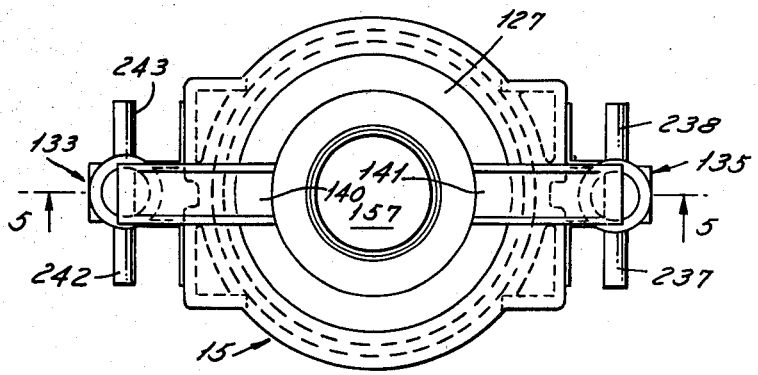
FIG. 4 is a top plan view of the push button activation valve illustrated in FIG. 3, taken along the line 4—4 thereof, and looking in the direction of the arrows.

Referring now to the drawings, and in particular to FIGS. 1, 2 and 3, an illustrative vacuum flushing water closet embodiment of the invention is shown which comprised a bowl, generally indicated by the numeral 10, on which is operatively mounted a conventional toilet seat, generally indicated by the numeral 11. The toilet seat 11 may be made from any suitable material, as for example, a suitable high impact plastic material such as polystyrene. As shown in FIGS. 2 and 3, the water closet or toilet of the present invention includes a flushing water spray ring, generally indicated by the numeral 12, which is operatively mounted around the upper inner periphery of the bowl 10. The bowl 10 is operatively mounted, as more fully described hereinafter, on a sewage discharge valve 13 that is supported on a suitable base plate, generally indicated by the numeral 14. The base plate 14 may be made from any suitable material, as for example, it may be an aluminum casting.

As shown in FIGS. 1, 2 and 3, the water closet of the present invention is provided with a pushbutton spring return activation valve, generally indicated by the numeral 15 which is located behind the seat 11 on the rim structure generally indicated by the numeral 27. The pushbutton valve 15 activates a vacuum-gravity timer, generally indicated by the numeral 16, which in turn initiates a flushing cycle by opening a flushing water flow valve 18 and activating a vacuum dispensing valve 17. The vacuum dispensing valve 17 directs vacuum to the sewage discharge valve 13 so as to open the same simultaneously with the flushing water valve 18 which directs water to the spray ring 12. As shown in FIG. 2, the structure of the present invention includes an outer shroud member, generally indicated by the numeral 19, which is secured in place between the rim 27 and a base plate 14.

The outer shroud member 19 is made from any suitable plastic material, as for example, an impact resistant plastic construction. The bowl 10 and the rim 27 are made from suitable heavy steel stampings which are covered with a suitable number of coats of a chemical resistant porcelain.

As illustrated in FIG. 2, the bowl 10 is releasably secured to the base plate 14 by a suitable number of lugs 20, which are welded to the outer face of the bowl 10, and by tie rods 21. The tie rods 21 may be of any suitable construction as, for example, a rod with a hook 40 on the upper end thereof which passes through a hole 41 in the lug 20, and with the lower end releasably secured in an upwardly extended pocket 42 in the base plate 14 by a lock nut 43.

As shown in FIGS. 1, 2 and 3, the bowl 10 includes a body portion 22 which has formed around the upper end thereof a circumferentially extended vertical wall portion 23. Integrally attached to the upper periphery of the body wall portion 23 is an outwardly extended horizontal flange 20 to which is welded an upper horizontal wall 28 of the rim 27. The lower end of the bowl body 22 terminates in a discharge spout 25 (FIG. 2) which has an outlet opening formed therethrough and indicated by the numeral 26 in FIG. 1.

As shown in FIG. 3, the rim 27 further includes an inner peripheral wall 29 which is integrally formed at its upper end with the horizontal rim wall 28, and which has its lower end folded outwardly and upwardly, as indicated by the numeral 30. It will be seen that the rim wall 29 is spaced inwardly from the bowl wall 23 so as to form a pocket around the upper periphery of the bowl 10 for the reception of the spray ring 12. The wall folded portion 30 forms a flange for releasably securing the spray ring 12 in the last mentioned recess. The rim 27 further includes an outer peripheral wall 31 which slopes outwardly and downwardly, and which has its lower end 32 folded inwardly to form a peripheral flange on which is seated a shroud retaining bracket 33 that extends around the inner periphery of the rim 27. The bracket 33 is secured to the rim wall 31 by any suitable means, as by welding. The rim 27 extends around the periphery of the bowl 10.

As shown in FIG. 3, the upper end of the shroud 19 is enlarged, as indicated by the numeral 34, and it is releasably seated in a peripheral channel formed by the bracket 33 and the rim wall portion 32. The shroud 19 includes an intermediate portion 35 which slopes downwardly and inwardly and terminates at a curved lower end 36. Integrally around the lower end 36 of the shroud 19 is a channel shaped shroud footing portion 37 which is adapted to be seated on the upper face of the base plate flat portion 38 which is adapted to engage the supporting surface or floor on which the toilet is mounted.

As shown in FIG. 1, the base plate portion 38 is provided with suitable holes, as 48, for mounting the toilet of the present invention on a floor by suitable bolts, as for example, aluminum bolts. The metal parts of the bowl 10, rim 27 and base plate 14 may be grounded through the base plate 14.

As illustrated in FIG. 2, the spray ring 12 is provided with an annular chamber 45. The spray ring 12 is made from any suitable material, as for example, a plastic material, and made in any manner, as for example, by extrusion. The spray ring 12 is provided with a shoulder 46 around the inner periphery thereof which is adapted to be seated on the shoulder formed by the rim wall flange 30, so that the spray ring may be releasably snapped into place. As shown in FIG. 2, the spray ring 12 includes a plurality of downwardly extended discharge holes 47 which extend through the lower wall of the spray ring 12 at an acute angle from the vertical axis. It has been found that the spray ring 12 provides an optimum device of this type, and that it is not subject to having the holes 47 plugged up from contaminants in the flushing water, such as alkalines, pebbles and the like. As shown in FIG. 3, flushing water is supplied to the spray ring 12 from a conduit or hose 228, which is connected to the outlet end of the flushing water supply valve 18, as shown in FIG. 2. The holes 47 are preferably formed at 45° from the vertical axis.

Figure 17:
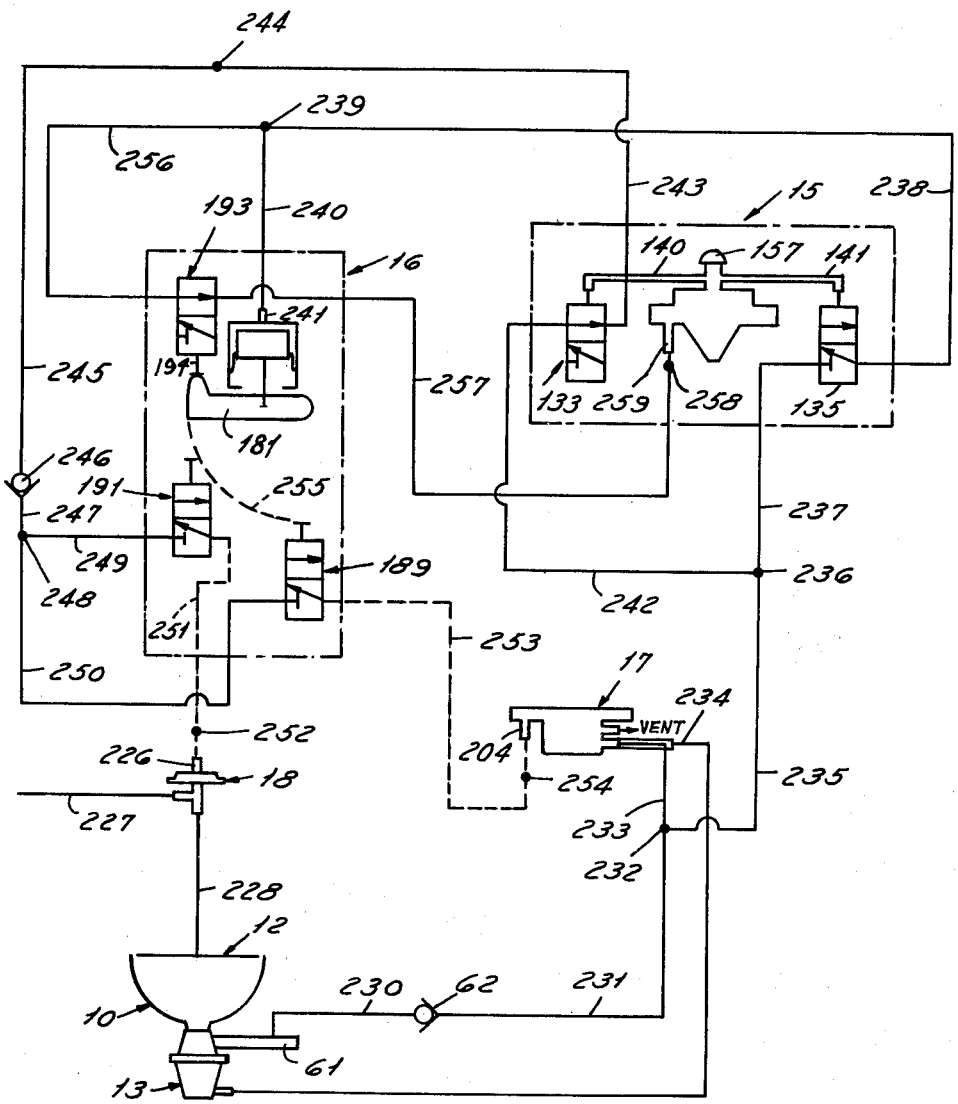
FIG. 17 is a schematic diagram of the water closet control system of the present invention.

As shown in FIG. 3, the toilet seat 11 is provided with a front opening 50 and a plurality of suitable bumpers 44. As shown in FIG. 1, the toilet seat 11 is hingedly mounted on suitable hinges 51. As shown in FIG. 2, each of the hinges 51 includes a threaded shaft 52 that is extended down through the rim wall 28. The shaft 52 is secured to the rim wall 28 by washers 54 and a suitable lock nut 53. The spray ring 12 supplies approximately two pints of clean flushing water during the flushing cycle. The flushing cycle lasts for about four seconds. As shown in FIG. 17, the flushing water supply valve 18 is operatively attached to a vacuum control line 226, and to a flushing water supply line 227. The flushing water supply line 227 is a ½" supply line, and it is operatively connected to a suitable inlet fitting generally indicated by the numeral 49 in FIG. 2. The inlet fitting 49 is adapted to be connected to a suitable supply of flushing water in any suitable manner. The flushing water supply valve 18 may be any suitable conventional vacuum operated flow control valve. The bowl 10 is vented through hole 55 in wall 23.

Figure 15:
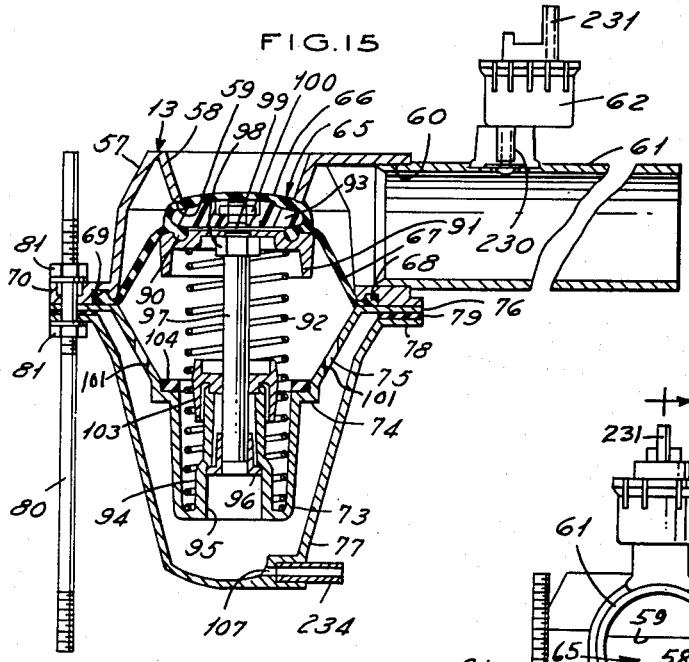
FIG. 15 is an elevational section view of the sewage discharge valve structure illustrated in FIG. 14, taken along the line 15—15 thereof, and looking in the direction of the arrows.
Figure 14:
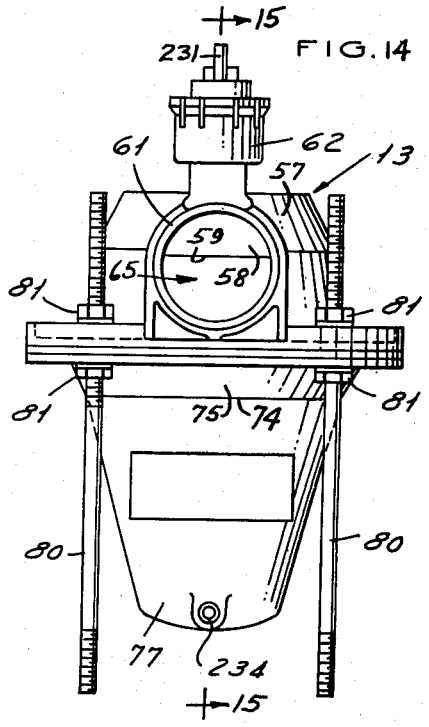
FIG. 14 is a fragmentary, elevational, section view, with parts removed, of a sewage discharge valve illustrated in FIG. 2, taken substantially along the line 14—14 thereof, and looking in the direction of the arrows.

As shown in FIG. 15, the sewage discharge valve 13 includes an upper valve housing 57 which has formed in the upper end thereof a conically shaped bowl seat formed by the wall 58. A circular valve seat 59 is formed on the lower inner end of the bowl seat housing wall 58, and it is adapted to be operatively opened and closed by a diaphragm type valve, generally indicated by the numeral 65. An outlet opening 60 is formed in one side of the valve housing 57 on a horizontal axis at right angles to the vertical axis of the valve seat 59.

Operatively mounted in the outlet opening 60 is an outlet pipe 61 which is provided with a smaller inner diameter than the outlet opening 60. As shown in FIG. 2, the spout or outlet neck 25 of the bowl 10 is adapted to be seated in the bowl seat 58, in a snap type relationship, and with suitable sealing means (not shown). As shown in FIG. 1, the outlet opening 26 in the bowl neck 25 is made to a smaller diameter than the inner diameter of the outlet pipe 61 and the subsequent sewage lines leading to the vacuum tank to which the toilet is connected, to facilitate removal of any foreign objects of a size that are not compatible with the sewage lines connected to the outlet pipe 61. In one embodiment, a 1½" inner diameter soil line was provided for connecting the toilet outlet pipe 61 to the vacuum tank. The numeral 62 designates a check valve which is connected to the toilet outlet pipe 61 by a conduit 230. As shown in FIG. 17, the check valve 62 is connected by means of the conduits 231 and 233 and the tee member 232 to the vacuum dispensing valve 17. The conduits 230, 231 and 233, and the vacuum conduits or lines hereinafter described, may also be made from suitable plastic tubing, such as vinyl plastic tubing.

As shown in FIG. 15, the sewage discharge diaphragm valve member 65 includes a mushroom shaped valve head 66, which is integrally formed in the center of an annular diaphragm attachment arm 67 that is provided with a peripheral attachment bead 68. The attachment bead 68 is seated in a circular groove 69 formed in the lower face of a flange 70 that is integrally formed around the lower end of the valve upper housing 57.

As shown in FIG. 15, the discharge sewage valve 13 includes a spring carrier member which comprises a lower cup-shaped portion 73 to which is integrally formed, on the upper end thereof, an outwardly extended flange 74 that is integral with an upwardly extended conical wall portion 75. An attachment flange 76 is integrally formed around the upper periphery of the conical wall portion 75, and it is seated against the lower face of the upper valve housing flange 70, and it secures the attachment bead 68 in place. The valve 13 further includes a substantially conically shaped lower housing 77 which is provided with an integral flange 78 around the upper open end thereof. As shown in FIG. 15, the flange 78 is mounted on the lower face of a suitable seal member 79 that is seated on the spring carrier flange 76. The flanges 76 and 78 are releasably secured together by a plurality of tie rods 80 and suitable lock nuts 81, as shown in FIG. 15.

As shown in FIG. 1, four tie rods 80 are used to secure the sewage valve 13 on the base plate 14. As shown in FIGS. 2 and 3, each of the tie rods 80 has its lower end extended through an opening 86 in the base plate raised portion 39. The tie rods 80 are secured in place by suitable lock washers 85 and lock nuts 87.

The tie rods 80 are also used for operatively mounting the vacuum-gravity timer 16, the vacuum dispensing valve 17 and the water flow control valve 18 in operative positions about the bowl 10 and within the shroud 19. As shown in FIGS. 1 and 2, the vacuum-gravity timer 16 is releasably mounted by suitable machine screws 71 to a mounting plate 72. The mounting plate 72 is secured on a pair of the tie rods 80 by the lock nuts 81. As shown in FIG. 3, the vacuum dispensing valve 17 is operatively carried on a mounting plate 82 which has its inner end fixed on the upper ends of two of the tie rods 80, as illustrated in FIGS. 1 and 3. As illustrated in FIG. 3, the mounting plate 82 is secured in place by an attachment plate 83 fixed on the upper end of the last mentioned tie rods, and a suitable lock nut 84. As shown in FIG. 3, the flushing water valve 81 is operatively carried on a mounting plate 88 which is similarly attached to the upper end of the other two tie rods 80 by a suitable attachment plate 89 and suitable lock nuts 84.

As shown in FIG. 15, the sewage valve 13 includes a valve head attachment bead 90 which is integrally formed with the valve head 66 and which is mounted in a circular groove formed on the upper face of a circular clamp and spring bearing member 91. A coil spring 92 is disposed with its upper end in abutment with the lower face of the clamp member 91 and its lower end seated in the cup shaped spring carrier member 73.

As shown in FIG. 15, the spring carrier member includes an integral sleeve 94 which is formed in the cup shaped member 73 and open at its lower end to the interior of the lower valve housing 77. The spring 92 is seated around the sleeve member 94. The sleeve member 94 has a stepped bore 95 formed therethrough and it has slidably mounted therein a valve rod guide member 96 which is fixed on the lower end of a valve rod 97.

As shown in FIG. 15, a lock nut 98 is threadably mounted on the valve rod 97 and it abuts the lower end of the clamp member 91. A spacer member 99 is mounted around the valve rod 97 above the clamp plate 91. A valve head backing member 93 is mounted inside the valve head 66 and the upper end of the rod 97 passes through the backing member 93. A lock nut 100 secures the valve head backing member 93 to the rod 97, and it also functions to clamp the bead 90 against the clamp member 91. The valve backing member 93 is made from a suitable rigid plastic material. It will be seen that the coil spring 92 normally maintains the valve head 65 in the closed position shown in FIG. 15.

As shown in FIG. 15, a plurality of openings 101 are formed through the conical wall 75 of the spring carrier member to communicate the chamber formed between the diaphragm valve 65 and the interior of the spring carrier member with the interior of the valve lower housing 77. A spring and valve rod guide member 103 is fixedly mounted by any suitable means on the upper end of the sleeve 94. A resilient annular cushion member 104 is mounted on the upper face of the spring carrier housing flange 74 to form a stop member for engagement with the lower end of the clamp member 91 when the diaphragm valve 65 is moved downwardly to the open position. The stop member 104 may be made from any suitable material, as for example, rubber and the like.

The lower end of the valve housing member 77 is provided with a port 107 to which is operatively attached one end of a vacuum line 234. As shown in FIG. 17, the other end of the vacuum line 234 is operatively attached to the vacuum dispensing valve 17. When the vacuum on both sides of the diaphragm valve 65 is balanced, the valve will open due to the varied differences in the differential areas on each side of the valve subjected to the vacuum, and the valve head 65 moves downwardly in a rapid opening action. A push-on hose connection member 63 for the 1½" soil line is operatively connected on the outlet pipe 61, as shown in FIG. 2.

Figure 5:
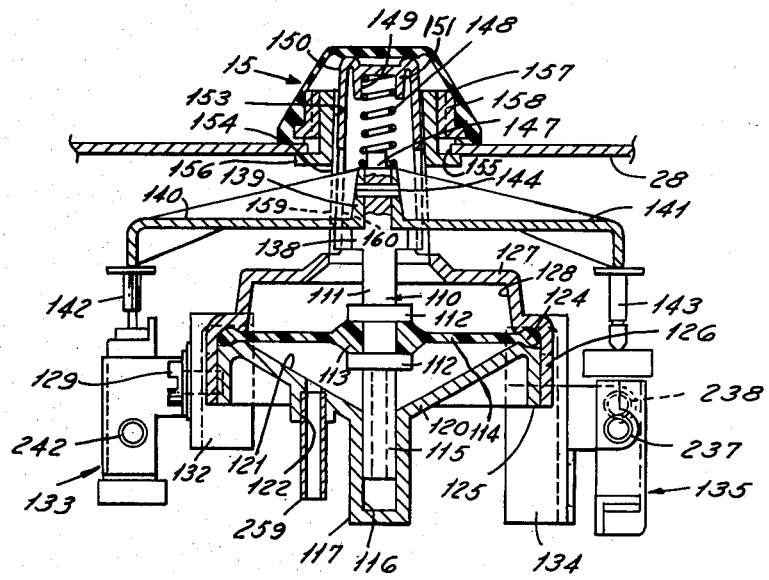
FIG. 5 is a fragmentary, elevational section view of the valve structure illustrated in FIG. 4, taken along the line 5—5 thereof, and looking in the direction of the arrows.

Referring now to FIG. 5, the push-button activation valve 15 includes a valve operating shaft generally indicated by the numeral 110, which includes a cylindrical body 111 that is provided at an intermediate portion thereof with a pair of integral longitudinally spaced apart flanges 112. The flanges 112 retain therebetween a central hub portion 113 of a circular flexible diaphragm member 114. The lower end 115 of the operating shaft 110 is slidably mounted in a cylindrical chamber 116 which is formed in a vertically disposed sleeve or cylindrical housing 117. The upper end of the housing 117 is integrally attached to the lower end of a conically shaped valve lower housing 120 which forms a valve housing chamber 121 beneath the diaphragm 114. A port 122 is formed through the wall of the valve lower housing chamber 120, and it is operatively connected through a vacuum line 259, fitting 258 and vacuum line 257 to valve 193 of the vacuum-gravity timer, as explained more fully hereinafter.

As shown in FIG. 5, the circular diaphragm 114 is provided around the periphery thereof with an attachment bead 124 which is held in place between the cylindrical flange member 125 formed on the outer end of the housing 120, and a cylindrical flange 126 formed on the outer periphery of a valve upper housing 127. The valve housing 127 forms an upper chamber 128 which is open to the atmosphere. The valve housing members 120 and 127 are releasably secured together by a plurality of suitable machine screws 129.

As shown in FIG. 5, a mounting member 132 is secured to the valve housing 127 by the machine screws 129. The mounting member 132 operatively supports a two-way flow control valve 133. A second mounting member 134 is also secured in the same manner to the housing 127 and operatively carries a second two-way flow control valve 135.

The valve operating shaft 110 is provided with a pair of sidewardly, outward extending guide members 138 on which is mounted the tubular hub 139 of a bridge member that carries a pair of integral bridge arms 140 and 141. The bridge arm 140 operatively carries a valve operator 142 for operating the valve 133. The bridge arm 141 operatively carries a valve operator 143 that operates a valve 135. The valves 133 and 135 are spring operated in one direction, and manually operated in the other direction by the valve operators 142 and 143.

As shown in FIG. 5, the bridge hub 139 is fixedly secured to the valve operator shaft 110 by suitable attachment pin 144. The upper end 147 of the operator shaft 110 has seated thereon the lower end of a spring 148 which has its upper end seated in a socket 149 in a spring cylinder 151 which is integrally formed on the inside of a tubular push button 150.

The push button 150 is slidably mounted in a bore 153 formed in a cylindrical neck or extension 154 integrally formed on the valve housing 127. The cylindrical valve neck portion 154 extends through an opening 155 in the bowl rim wall 28, and it includes a flange 156 which abuts the inner surface of the rim wall 28. The push button 150 is enclosed by a rubber boot 157 which has an inwardly extended flange seated on the outer face of the rim wall 28. A retainer 158 is threadably mounted on the outer end of the cylindrical neck member 154 and secures the boot 157 in place and the valve housing 127 in place on the rim wall 28. The bridge members 140 and 141 extend sidewardly out through slots 159 formed in diametrical opposite sides of the cylindrical neck 154 and through slots 160 formed through the inner end of the push button 150.

Figure 6:
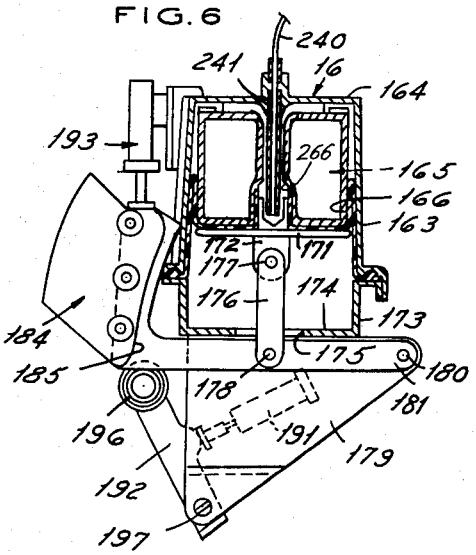
FIG. 6 is a fragmentary, elevational section view of the vacuum-gravity timer illustrated in FIG. 2, taken along the line 6—6 thereof, and looking in the direction of the arrows.
Figure 7:
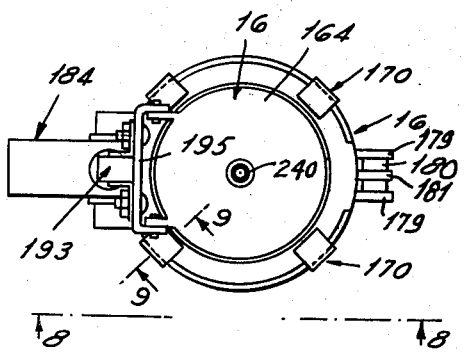
FIG. 7 is a top plan view of the vacuum-gravity timer illustrated in FIG. 8, taken along the line 7—7 thereof, and looking in the direction of the arrows.
Figure 8:
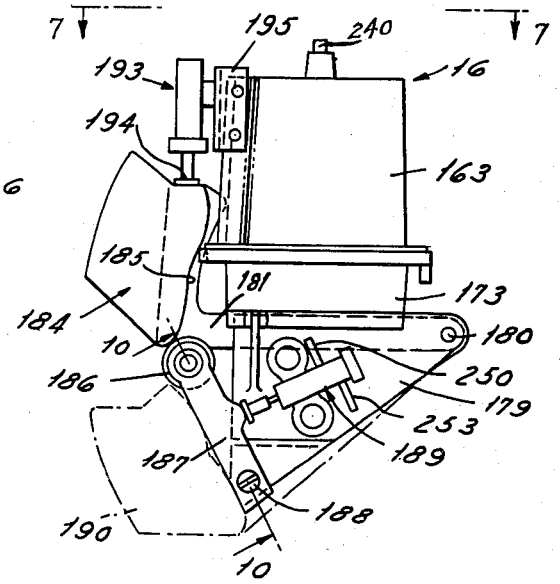
FIG. 8 is an elevational view of the vacuum-gravity timer illustrated in FIG. 7, taken along the line 8—8 thereof, and looking in the direction of the arrows.
Figure 9:
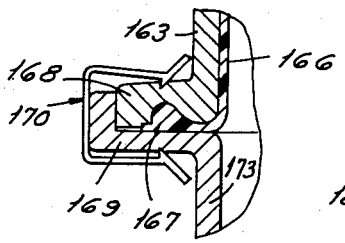
FIG. 9 is a fragmentary, enlarged, elevational section view of the vacuum-gravity timer structure illustrated in FIG. 7, taken along the line 9—9 thereof, and looking in the direction of the arrows.

The vacuum-timer 16 is shown in detail in FIGS. 6 through 10. As shown in FIG. 6, the timer 16 includes a housing having an upper end portion that includes a cylindrical side wall 163 and an upper end wall 164. A piston generally indicated by the numeral 165 is operatively mounted within the upper end of said housing, and it is provided with a movable seal 166. As shown in FIG. 9, the outer end of the seal 166 is provided with a peripheral bead 167 that is seated between a flange 168 formed on the housing wall 163, and a flange 169 formed on the cylindrical lower housing wall 173. The flanges 168 and 169 are releasably secured together to hold the bead 167 in place by a plurality of spring clips, generally indicated by the numeral 170 in FIG. 7.

As shown in FIG. 6, the cylinder lower end housing includes an end wall 174 which is integral on the side wall 173. The end wall 174 is provided with an opening 175 through which is extended a lever arm 176. The lever arm 176 is pivotally mounted at its upper end on a pivot pin 177 which is carried on a bracket 172 carried on the lower end of the piston 165. The inner end of the seal 166 is secured to the lower end of the piston 165 by a suitable retainer plate 171.

The lower end of the lever 176 is pivotally mounted by a pivot pin 178 to a cam carrier or cam arm 181. The cam arm 181 is pivotally mounted at one end thereof on a pivot pin 180 that is carried on a first vertical mounting plate 179 that is fixed by any suitable means to the lower end of the housing 173. The cam arm 181 has fixedly on the other end thereof a double faced cam 184. As shown in FIGS. 6 and 8, the cam 184 carries a pair of vertically disposed cam faces 185 with the cam faces 185 being disposed on opposite sides of the cam arm 181.

Figure 10:
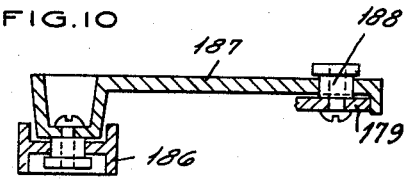
FIG. 10 is a fragmentary, enlarged, elevational section view of the vacuum-gravity timer structure illustrated in FIG. 8, taken along the line 10—10 thereof, and looking in the direction of the arrows.
Figure 16:
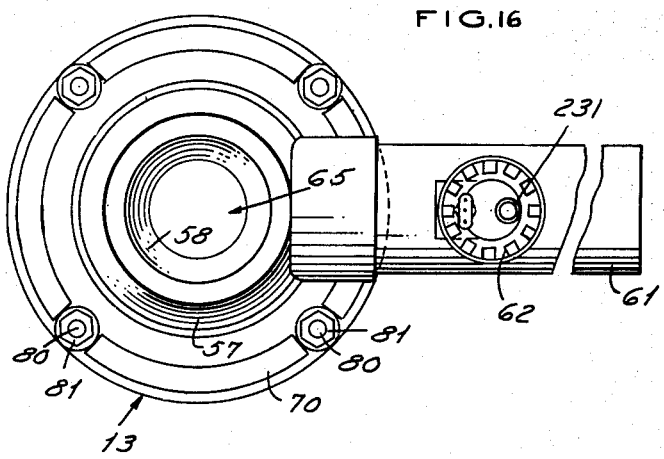
FIG. 16 is a top plan view of the structure illustrated in FIG. 14, and turned 90° clockwise (as viewed in FIG. 16) from the position shown in FIG. 14.

As shown in FIGS. 8 and 10, one of the cams 185 is adapted to operatively engage a cam follower 186 mounted on a cam follower carrier 187 which is pivoted by the pivot screw means 188 on one of the mounting plates 179. When the cam 184 moves down to the broken line position indicated by the numeral 190 in FIG. 8, the cam 186 and its carrier 187 will be swung to the right or clockwise, as viewed in FIG. 8, so as to operate a two-way flow control valve generally indicated by the numeral 189. Operatively connected to the valve 189 are a pair of vacuum lines 250 and 253. As shown in FIGS. 2 and 6, a second cam follower carrier 192 is pivotally mounted by suitable pivot screw means 197 on the lower end of the second mounting plate 179. The carrier 192 operatively carries the cam follower 196 on its upper end which engages the other cam surface 185. The cam follower carrier 192 is adapted to operate a second two-way flow control valve 191, as shown in FIG. 6. As shown in FIG. 17, the valve 191 is operatively connected to a pair of vacuum lines 249 and 250. As shown in FIG. 8, the cam 184 operatively engages the plunger 194 of the two-way valve 193 when it is in the upper position shown in FIG. 8. The valve 193 is operatively mounted on a bracket 195 which is fixedly secured by a suitable means to the upper end wall 164, as shown in FIG. 7.

The vacuum dispensing valve 17 is shown in detail in FIGS. 11, 12 and 13. As shown in FIG. 12, the valve 17 includes a circular diaphragm 198 which is provided with a peripheral bead 199 that is retained in a groove in a flange 201 formed around the periphery of an upper valve housing 202. A retainer ring 200 engages the upper side of the bead 199. As shown in FIG. 11, the retainer ring 200 is releasably secured in place against the bead 199 by a plurality of spring clips 203. As shown in FIG. 12, a vacuum line 204 is operatively connected to an inlet port 205 which communicates with the chamber 206 formed between the diaphragm 198 and the upper face of the housing 202.

As shown in FIG. 12, a diaphragm plate 207 is mounted inside of the diaphragm 198 and the inner face thereof is provided with an inwardly extended central bias which extends downwardly into a suitable axial hub 209 formed on a diaphragm 224. The diaphragm 224 is provided with a peripheral bead 210 which is secured between the upper end of an upper intermediate housing 211 and a flange 263 formed around an opening 264 in the housing 202.

As shown in FIG. 12, a chamber 212 is formed in the upper intermediate housing 211 and is enclosed on its upper end by the diaphragm 224. The chamber 206 in the upper housing 202 is enclosed at its lower end by the diaphragm 224. The lower end of the intermediate housing 211 is provided with a central bore 213 at the lower end of the chamber 212. The bore 213 is in alignment with a second bore 215 formed through a lower intermediate housing 216. Operatively mounted in the bores 213 and 215 is a vertical shaft 214, that has its upper end operatively mounted in a socket in the lower valve face of the diaphragm hub 209, and its lower end operatively mounted in a socket in the upper valve face of the hub 218 of a lower diaphragm 225. Shaft 214 has a triangular cross section.

As shown in FIG. 12, an intermediate chamber 217 is formed between the intermediate housings 211 and 216. The chamber 217 communicates with the vacuum line 234 through the passage 265. The chamber 217 is normally vented to the chamber 212 since it has communication past the triangular cross section shaft 214. The chamber 212 is normally vented to the atmosphere through a suitable opening that is connected if desired to a suitable vent line 267. The working vacuum supply line 233 is connected to a chamber 271 which is normally closed when the diaphragm valve 225 is in the closed position shown in FIG. 12. In the closed position shown in FIG. 12, the inner end 269 of the diaphragm hub 218 functions as a valve to seat against the adjacent intermediate housing portion 216. When pilot vacuum is impressed through the vacuum line 204 onto the chamber 206, the diaphragm 198 and its connected structure is moved downwardly so as to bring the valve end 268 on the diaphragm hub 209 into engagement with the valve seat 270 to block the chamber 217 from the atmosphere. Simultaneously, the valve end 269 of the hub 218 is moved downwardly against the action of the spring 219 to permit the chamber 271 to communicate through the bore 215 and around the shaft 214 with the chamber 217. Working vacuum then flows from the vacuum line 233 through the chambers 271 and 217 and thence out through the passage 265 and into the vacuum supply line 234 for the sewage discharge valve 13.

A lower housing 220 retains a bead 229 on the lower diaphragm 225 in place against the lower end of the intermediate housing 216. As shown in FIGS. 12 and 13, the housings 202, 211, 216 and 220 are fixedly secured together and to the mounting plate 82 by suitable machine screws 222 and lock nuts 223. The spring 219 is operatively mounted within the lower housing 220, and its upper end abuts the diaphragm hub 218 on the lower diaphragm 225 to normally bias the diaphragm 225 and the shaft 214 upwardly.

In use, the push button valve 15 is pushed downwardly to provide pilot vacuum to the gravity timer 16 through the normally closed valve 135. As shown in FIG. 17, one side of the valve 135 is connected to the vacuum line 237, tee 236, vacuum line 235, tee 232, vacuum line 231, check valve 62 and vacuum line 230 to the working vacuum line 61. The other side of the valve 135 is connected by the vacuum line 238 and the tee 239 to the vacuum line 240, that is operatively connected to a vacuum tube 241 that extends internally into a central passage 266 in the piston 165. The pilot vacuum communicates through the inner end of the tube 241 with the passage 266, and thence upwardly as viewed in FIG. 6 to the upper end of the housing above the piston 165. The vacuum thus impressed on the upper end of the piston 165 moves the piston from a normally downward position to swing the lever 181 up from the lower end of the arc 255 of FIG. 17 into the solid line position shown in FIG. 17 by the numeral 181. When the lever 181 is swung to the upper position shown in FIGS. 6 and 7, the plunger 194 of the valve 193 is operated to move the valve 193 from the open position to the closed position. Prior to this time, vacuum passed from the tee 239 through the vacuum line 256, and through the valve 193, the vacuum line 257, the junction fitting 258 and the vacuum line 259 into the port 122 and into the chamber 121 of the valve 15, as shown in FIG. 5. The vacuum operating in the lower end of the valve 15 and the chamber 121 functions with the diaphragm 114 to provide a holding action if the vacuum in the system is not up to the level at which the system will flush. If the vacuum is below the flush level, then the vacuum in the chamber 121 will hold the activation switch 15 in the depressed position until the vacuum comes up to the flushing value.

If the vacuum is above the pre-set low, then the valve 193 will be shifted to the closed position by the lever 181 and the vacuum in the chamber 121 will be vented to the atmosphere through valve 193. Valve 15 then returns to its normal position shown in FIG. 17 to direct pilot vacuum to the two valves 189 and 191. Pilot vacuum is supplied to the valve 133 from the working vacuum line 61 through the vacuum line 230, check valve 62, vacuum line 231, tee 232, vacuum line 235, tee 236, and vacuum line 242. Pilot vacuum is supplied from the valve 133 to the valves 189 and 191 through the vacuum line 243, the fitting 244, the vacuum line 245, check valve 246, tee 248 and vacuum lines 250 and 249, respectively. The vacuum in the piston chamber above the gravity timer piston 165 is then vented to the atmosphere through valve 135. The piston 165 then moves downwardly by gravity and the lever 181 swings downwardly to move the cam followers 186 and 196 and their carrier arms 187 and 192 inwardly, as viewed in FIGS. 6 and 8. This action operates the normally closed valves 191 and 189 in sequence, with the valve 191 being first operated to the open position to direct pilot vacuum through the vacuum line 251, the junction 252 and the vacuum line 226 to the flushing valve 18. Flushing water is then supplied to the spray ring 12, and a second or so later, the opening of the valve 189 directs pilot vacuum from the valve 189 through the vacuum line 253, the junction 254 and the vacuum line 204, into the vacuum dispensing valve 17. The vacuum dispensing valve 17 is then operated to move the diaphragm 198 downwardly so as to move the shaft 214 downwardly and permit vacuum to flow from the vacuum line 233 into the vacuum line 234 and into the discharge valve 13. When the vacuum on both sides of the diaphragm 67 of the sewage discharge valve 65 approaches a balanced point, the valve 65 moves downwardly to provide a rapid opening of the valve 13 to permit the sewage to be sucked out of the bowl 10 and into the outlet pipe 61.

The operation of the water closet flush lasts for about for seconds and two pints of clean flushing water is deposited in the bowl 10. A residual one pint of flushing water remains in the bowl 10 after a flushing cycle. The flushing cycle is terminated when the cam 181 has passed completely downward past vacuum followers 186 and 196 to the initial starting position indicated by the numeral 190 in FIG. 8. At this point the valves 189 and 190 return to their normally closed positions so as to vent the vacuum lines 251 and 253 and de-energize the sewage discharge valve 13 and the vacuum dispensing valve 17. The system is then returned to its original starting condition and is now ready for another cycle of operation which can be commenced by pushing down again on the activation valve 15.

The spring 148 in the activation switch 15 provides a safety factor in that if the switch is depressed by a person's foot in a rough manner, the switch will not be damaged because the shock is first taken up by the spring 148 before the spring 148 bottoms out and moves the bridge operator downwardly.

It will be seen that the control apparatus for the flush closet of the present invention is constructed and arranged so that only the predetermined amount of two pints of water will be deposited in the bowl regardless of how long the push button 15 is depressed.

It will be seen that the operating time of the flushing water valve 18 and the sewage discharge valve 13 are controlled by the vacuum-gravity timer 16. It will also be seen that the timer 16 is adapted to provide two time periods, namely, one for the vacuum flush opening and another for the water flushing period. For example, the timer 16 operates the valve 191 to provide an operation period of the flushing water valve 18 of about four seconds, and for an operation period of the discharge valve 13 of about 1½seconds. The total overall cycle lasts for about ten seconds, with half of the time for the working or flushing operation and with half of the time employed for loading or triggering the timer 16. Experience has shown that the vacuum operated water closet of the present application is an efficient and practical water closet which can be used in conditions where a shockproof toilet is required, as for example, in marine sanitation devices.

While it will be apparent that the preferred embodiment of the invention herein disclosed is well calculated to fulfill the objects above stated, it will be appreciated that the invention is susceptible to modification, variation and change.

What is claimed is:

1. A fluid flow activation switch, comprising:

(a) a housing having a cylindrical chamber open at one end to the atmosphere and closed at the other end;

(b) a circular flexible diaphragm member disposed in said cylindrical chamber and having a circular periphery sealingly fixed to the housing to divide said cylindrical chamber into one portion open to the atmosphere and one portion sealed from the atmosphere;

(c) a vacuum line is connected to said cylindrical chamber sealed portion to admit vacuum to provide a selective holding action on the operating shaft;

(d) a valve operating member having an operating shaft movably mounted in said cylindrical chamber in said housing, and attached to said diaphragm;

(e) a push button member;

(f) spring means interconnecting said push button member and said valve operating member;

(g) a pair of normally closed, two-way vacuum flow control valves mounted on said housing;

(h) a bridge member fixedly mounted on said operating shaft and having a pair of bridge arms attached thereto;

(i) each of said bridge arms having a valve operator mounted thereon for operative engagement with one of said flow control valves for operating the same, whereby when the push button member is depressed the operating shaft is moved, from an initial position, inwardly of said housing into an advanced position so as to flex said diaphragm member into said cylindrical chamber sealed portion, and the bridge member and valve operators are moved to operate said flow control valves from normally closed positions to open positions, and vacuum admitted through said vacuum line into said cylindrical chamber sealed portion holds the diaphragm and operating shaft in said advanced position to hold the flow control valves in said open positions, and when the vacuum is releasing from said cylindrical chamber sealed portion, the diaphragm member will return the operating shaft to its initial position and the bridge and valve operators will return the flow control valves to their normally closed positions.

* * * * *

UNITED STATES PATENT OFFICE

CERTIFICATE OF CORRECTION

Patent No. 4,237,934 Dated December 9, 1980

Inventor(s) Charles E. Gregory, et al

It is certified that error appears in the above-identified patent and that said Letters Patent are hereby corrected as shown below:

Column 4, line 17, "20" should be --24.
Column 6, line 44, "81" should be --18--.
Column 9, line 46, "bias" should be --boss--.

Signed and Sealed this

*Thirty-first* Day of *March 1981*

[SEAL]

*Attest:*

RENE D. TEGTMEYER

*Attesting Officer* *Acting Commissioner of Patents and Trademarks*